United States Patent [19]

Melcher

[11] Patent Number: 4,599,836

[45] Date of Patent: Jul. 15, 1986

[54] SELF-STORING WINDOW ASSEMBLY

[76] Inventor: Randy Melcher, 702 N. Helena, Spokane, Wash. 99202

[21] Appl. No.: 747,164

[22] Filed: Jun. 20, 1985

[51] Int. Cl.[4] ..... E06B 3/26

[52] U.S. Cl. ..... 52/202; 49/62

[58] Field of Search ..... 52/207, 788, 398, 202; 49/62, 63

[56] References Cited

U.S. PATENT DOCUMENTS

| | | | |
|---|---|---|---|
| 2,804,954 | 9/1957 | Gillespie | 52/398 X |
| 2,910,740 | 11/1959 | Greenman . | |
| 3,024,837 | 3/1962 | McPhail . | |
| 3,442,059 | 5/1969 | Kessler | 52/788 X |
| 3,636,661 | 1/1972 | Strawsine . | |
| 3,824,753 | 7/1974 | Anderson . | |
| 3,875,706 | 4/1975 | Okawa | 52/788 X |
| 4,021,980 | 5/1977 | Wilfong . | |
| 4,028,849 | 6/1977 | Anderson . | |
| 4,074,483 | 2/1978 | Vickstrom . | |
| 4,121,394 | 10/1978 | Brooks . . | |
| 4,175,357 | 11/1979 | Goldhaber . | |
| 4,248,018 | 2/1981 | Casamayor . | |
| 4,295,305 | 10/1981 | Shelver . | |
| 4,351,137 | 9/1982 | Enyart et al. . | |
| 4,409,758 | 10/1983 | Dickerson et al. . | |
| 4,452,020 | 6/1984 | Werner . | |

*Primary Examiner*—Carl D. Friedman

*Attorney, Agent, or Firm*—Wells, St. John & Roberts

[57] ABSTRACT

An improved window frame system for slidably retaining sashes in self-storing windows. The frame system comprises four channel members disposed about an opening, having tracks for receiving sashes. A plurality of filler strips are removably positioned in the tracks. The sashes are engaged in the tracks by the filler strips. By removing segments of the filler strips the sashes can be removed from the windows.

9 Claims, 26 Drawing Figures

FIG 1
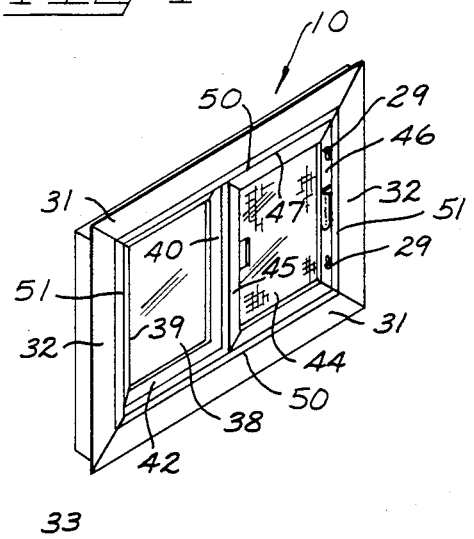
FIG 2
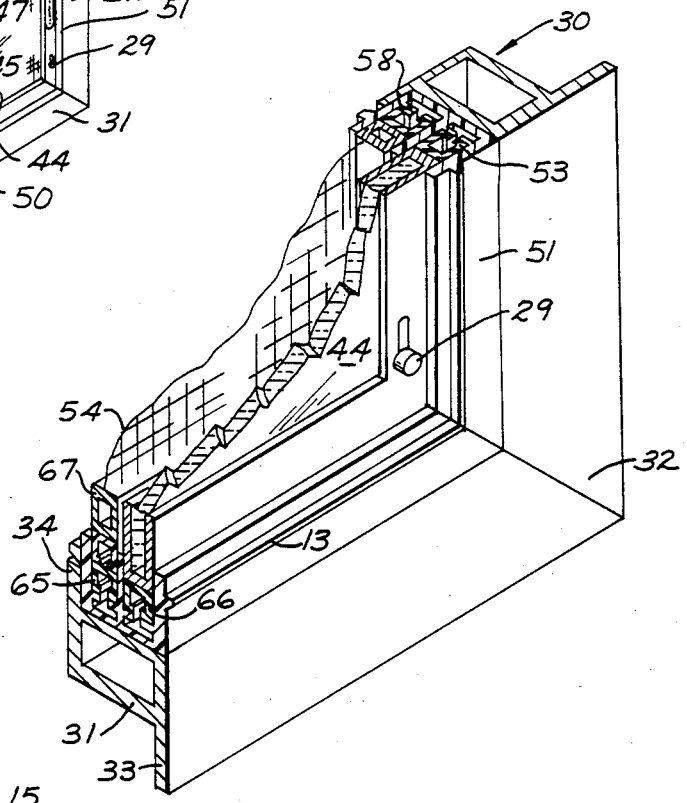
FIG 3
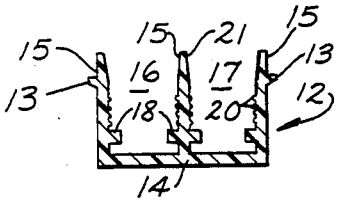
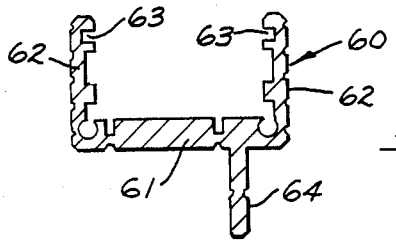
FIG 4

SELF-STORING WINDOW ASSEMBLY

FIELD OF THE INVENTION

This invention relates to the construction and design of windows or doors. It presents a frame system for slidably retaining sashes in self-storing windows.

BACKGROUND OF THE INVENTION

Conventional self-storing storm windows are generally of two types. In the first type, some of the sashes are attached to the supporting frame, and a sliding sash is guided by removable guides. This requires the use of tools if the sashes are to be removed.

The other type has multiple sashes riding in multiple fixed tracks. In order to facilitate removal of the sashes for cleaning, opposed sets of tracks have one track deeper than the other. A sash can be shifted into the deeper track until its opposite edge clears the other track, and can then be removed. With sashes removable in this way, there is no security against unauthorized entry through the window, since the sashes can be removed from either side. This type of structure is disclosed in U.S. Pat. Nos. 2,910,740 and 3,636,661. In addition, when one track is deeper than the other to allow installation or removal of sashes, there is an air space between the base of the deeper track and the adjacent edge of the sash. This is undesirable in a window, since it allows infiltration of air and water.

To facilitate removal of all sashes and still prevent unauthorized entry from outside, another design utilizes retractable pins mounted on the sides of the sashes. The pins, not the sash itself, ride in the tracks. With the pins retracted from the inside, the sashes can be be removed. This design, however, allows a considerable amount of air and water infiltration between the sashes and the tracks.

BRIEF DESCRIPTION OF THE DRAWINGS

FIG. 1 is a perspective view of a self-storing window assembly;

FIG. 2 is an enlarged fragmentary perspective view of the lower right-hand corner of the assembly in FIG. 1;

FIG. 3 is a cross-sectional view of the channel member;

FIG. 4 is a cross-sectional view of the channel retainer;

FIGS. 14 through FIG. 26 are a series of paired schematic elevation and perspective views showing disassembly of the window of FIG. 1.

DETAILED DESCRIPTION OF THE PREFERRED EMBODIMENT

In compliance with the constitutional purpose of the Patent Law "to promote the progress of science and useful arts" (Article 1, Section 8), applicant submits the following disclosure of the invention.

The present invention arose out of the need for a self-storing window assembly, useable either as a primary window or as a storm window, from which all sashes could easily be removed for cleaning. The window assembly also had to prevent air and water infiltration when the sashes were in their closed position.

In addition there was also a need for a self-storing window which was secure against unauthorized entry from the outside. Other requirements were that it be easy to install, require low maintenance and be cost-competitive with other designs. It also provides a single track extrusion and uniform frame components usable at all sides and ends of the assembled window. This design also permits the same window assembly to be used in either a horizontal or vertical orientation.

Figure 13:
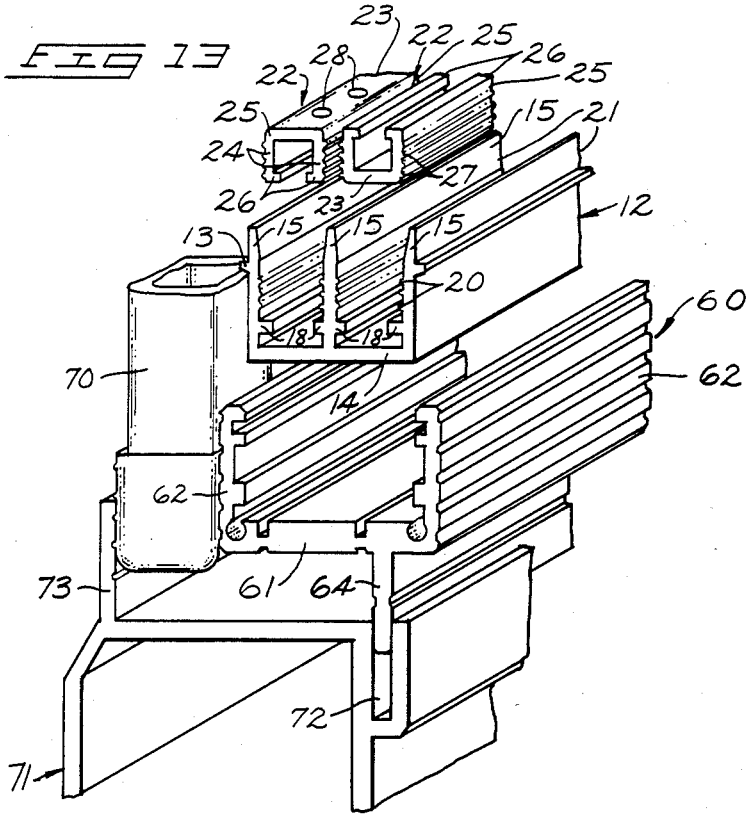
FIG. 13 is a fragmentary exploded view of the frame assembly and support frame of FIG. 12.
Figure 12:
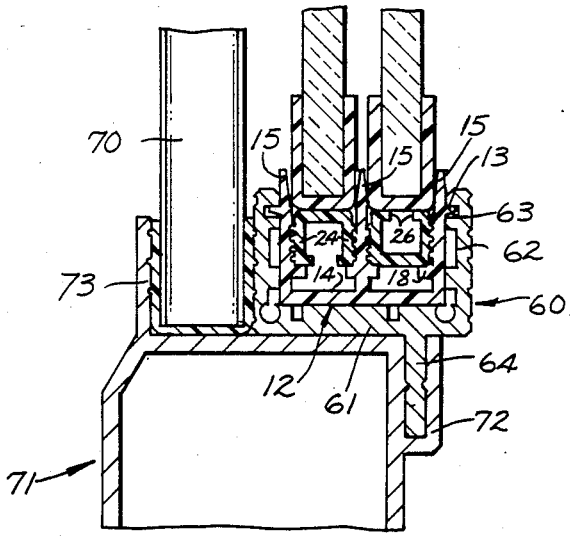
FIG. 12 is a cross-sectional view showing the frame assembly attached to a support frame.

The present frame system utilizes a channel member 12 generally illustrated in FIGS. 3, 12 and 13. It has a transverse base 14. Three substantially parallel walls 15 project perpendicularly to one side of base 14, presenting an inner U-shaped track 16 and a parallel, outer U-shaped track 17. When the channel members 12 are installed in a window, the outer tracks 17 are positioned away from the interior of the structure and the inner tracks 16 are positioned toward the interior of the structure. The inner track 16 and outer track 17 are each adapted to receive one or more track fillers 22, as shown in FIGS. 12 and 13.

The inner surfaces of channel member walls 15, as illustrated in FIGS. 3 and 13, have elongated paired interior shoulders 18 which are parallel with and spaced outwardly from the channel member base 14. The interior shoulders 18 have two functions. The first is to provide a support for track fillers 22 when they are positioned within the tracks 16 and 17. The second function is to provide a raceway between channel member base 14 and track fillers 22. The raceway allows a portion of a connecting device, such as a bolt or a screw, to protrude through channel member base 14 without interfering with the overlying track fillers 22.

In the embodiment illustrated, the inner surfaces of walls 15 also have longitudinal ridges 20, parallel with the channel member base 14, and spaced outward from the channel member shoulders 18. The purpose of the longitudinal ridges 20 is to frictionally retain track fillers 22 in position when they are installed in tracks 16 and 17. While longitudinal ridges 20 are shown in the preferred embodiment, any suitable means of frictionally retaining the track fillers 22 in the tracks 16 and 17 may be utilized.

As illustrated in the preferred embodiment shown in FIG. 3, the edges 21 of the walls 15 are slightly tapered to facilitate positioning of track fillers 22 or the window sash within the tracks 16 and 17.

The channel member 12 is preferably constructed of a strong extruded plastic, relatively rigid, but having some resiliency. However, it can also be made from any inexpensive lightweight material which is relatively rigid but has some resiliency, such as aluminum.

Each track filler 22 comprises a transverse base 23 connecting two substantially parallel walls 24, forming a U-shaped configuration. The edges of the walls 24 are turned inwardly, forming two elongated edge flanges 26. Flanges 26 are parallel to the track filler base, and are turned at substantially a 90 degree angle with respect to the track filler walls 24.

Each track filler 22 has opposed outer surfaces 25 complementary to the open tracks 16 and 17. The track fillers are adapted to be removably positioned within a track of a channel member 12. The outer surfaces 25 of the walls 24 have one or more parallel elongated ridges 27 which are parallel with the track filler base 23. The ridges 27 are adapted to resiliently interlock with the channel member ridges 20 when the track filler 22 is positioned in tracks 16 and 17. While the preferred embodiment as illustrated shows the parallel track ridges 27, any suitable means of frictionally retaining the track fillers 22 in the tracks 16 and 17 may be utilized.

As illustrated in FIG. 13, the track filler base 23 has a number of holes 28 formed through it. The holes 28 allow the track filler 22 to be grasped by a hook or other tool (not shown) for removal from the tracks 16 and 17. They are also used in cooperation with conventional sliding barrel or pin latches 29 to position or lock a sash relative to the window frame.

As illustrated in FIGS. 12 and 13, the track fillers 22 may be positioned in tracks 16 and 17 either with the base 23 bearing against the interior shoulders 18, or with the flanges 26 resting on shoulders 18. In either case, the track filler bases 23 or flanges 26 provide a smooth, tightly-fitting surface about the perimeter of the installed sashes.

The track fillers 22 are preferably made from a strong, relatively rigid plastic extrusion having some resiliency. However, track fillers 22 may be of any material which has similar properties, such as aluminum. Aluminum track fillers are of particular benefit in that they are stronger and provide more support for carrying the weight of a sash resting vertically on them parallel to the elongated track fillers. The ability to support such weight is particularly useful in designing vertically sliding self-storing window assembies.

In a modified configuration (not shown) the track filler is the same as illustrated in FIG. 12, with the exception that there are no track filler flanges 26 along the exterior sides of the track filler walls 24. Instead, the track filler walls 24 are not quite perpendicular to the track filler base 23, and the outer edges of walls 24 are spaced apart a distance slightly greater than the width of track filler base 23. This alternate shape of the track fillers 22 provides a frictional fit between the track filler 22 and the walls defining tracks 16 and 17. Frictional force is provided by the resiliency of the track filler walls, which attempt to expand when constricted in tracks 16 and 17.

The orientation of the support frame 30 as shown is not necessary to the practice of this invention. The support frame 30 could be installed either horizontally as shown, or vertically with the second sash 44 being a sliding sash being installed either on the left side or the right side in the horizontal orientation or on top or on the bottom in a vertical orientation.

As used herein, the word sash means a frame surrounding a panel. The panel can be made of any material suitable for use in a window, such as glass, plastic, screen or fabric, among others.

The window assembly as described herein can be used either as a primary window or as a storm window. It can be installed on doors as well as windows, and can be either vertical or horizontal.

FIG. 12 and FIG. 13 illustrate the use of channel members 12 and track fillers 22 in conjunction with a first embodiment of a surrounding channel retainer 60. Its cross-section is detailed in FIG. 4 The outside surfaces of channel member walls 15 have elongated exterior shoulders 13. These shoulders 13 are adapted to interlock within complementary grooves 63 in the channel retainer walls 62. The channel retainer 60 comprises a base 61 having two substantially parallel walls 62 projecting perpendicularly to one side of base 61. The base 61 and walls 62 have inner surfaces forming a U-shaped open configuration adapted to receive channel members 12.

The channel retainer 60 also has a flange 64 that is perpendicular to the base 61 and extends in a direction opposite to the walls 62. As shown, the flange 64 is located to one side of a centerline extending along the channel retainer base 61. The flange 64 is used to attach channel retainer 60 to the support frame member 71. If desired retainer 60 and channel member 12 can be an integral unit, and can be further combined with an integral support frame structure as well.

Each channel member 12 is designed to be positioned within the channel members 12 with its base 14 engaging the channel retainer base 61. Channel member 12 is removably locked in retainer 60 by engagement of shoulders 13 and grooves 63 (See FIG. 12). Channel member 12 could also be fixed within retainer 60 by other means, such as an adhesive, mechanical fasteners or screws.

In the embodiment shown in FIGS. 12 and 13, a support frame member 71 has an elongated slot 72 adapted to receive the channel retainer flange 64 about the window periphery. To prevent any possibility of the removal of channel retainer 60 from frame member 71, screws or bolts would normally be driven perpendicularly through slot 72 and flange 64.

To present a more secure window assembly, channel retainer 60 can be installed parallel to and spaced apart from an exterior peripheral flange 73 that extends about frame member 71, forming a U-shaped guideway adapted to receive the ends of rigid cross members or a grill 70. The addition of cross members or a grill 70 provides additional physical security to the window or door assembly to prevent unauthorized entry through it.

The channel retainer 60, as pictured in FIGS. 12 and 13, is installed on support frame member 71 with the wider portion of the channel retainer base 61 overlapping support frame member 71. If a grill is desired, the channel retainer 60 can be installed with the wider portion of channel retainer base 61 extending outward from support frame member 71. The more narrow portion of channel retainer base 61 would then overlap support frame member 71. This arrangement provides the required space between channel retainer wall 62 and flange 73 for installation of cross members or grill 70. Alternatively, the channel retainer 60 can be installed on a support frame which is of reduced thickness. In that case, channel retainer wall 62 can be positioned against flange 73, eliminating the grill support guideway, or the retainer 60 can be reversed to present a guideway.

FIGS. 1, 2 and 5–11 show a typical self-storing window assembly 10. This configuration consists of a rectangular support frame 30, which comprises two parallel side members 31 joined at their ends by two perpendicular end members 32. Around the inner edge of the support frame 30 is a mounting flange 33, which is utilized to attach the window frame 30 to the structure on which it is mounted. Any type of conventional fastening means, such as screws or bolts, may be used to attach the flange to the supporting building, door or window structure. The frame 30 also has an outside peripheral flange 34, around the window opening for confining the channel members that hold the sashes. Flange 34 prevents removal of the channel members from outside, as well as helping provide a weather tight seal between the channel members and the support frame 30. Its outermost edge is preferably overlapped by the flanges 13 on the channel members, which act as a protective drip cap, preventing rain or water from entering between the channel members and flange 34.

A group of four elongated channel members, having the details previously described, are installed in a rectangular configuration around the window opening defined by the frame members 31, 32. The channel members include two parallel side channel members 50 and two parallel end channel members 51 extending perpendicularly between their respective ends.

In the illustrated embodiment, the channel members 50 and 51 are held in place within the support frame 30 by a commercially available weather resistant adhesive material. As an alternative, the channel members could also be fastened to the frame 30 by any type of fastening device such as screws or bolts. If desired, the surrounding frame members can interlock directly with shoulders 13 to hold the channel members in place.

The complete self-storing window assembly 10 has a first sash 38, a second sash 44 and a third sash 54 installed. The first sash 38 and third sash 54 are positioned in the outer tracks 17 of the channel members. Second sash 44 is positioned in the inner tracks 16 of the channel members. Additional sashes can be added when required.

In a typical self-storing window assembly as illustrated, sashes 38 and 44 will normally include rectangular panes of glass. Sash 54 will normally include a taut panel of ventilating screen material. Other panel materials can be substituted as desired. Sashes 38 and 54 are usually stationary. Sash 54 typically includes a bracket 48 at one end to facilitate its handling for removal or replacement purposes (see FIGS. 6 and 9). Sash 44 also has a bracket 49 at one end to assist a user in shifting the sash along the supporting channels (see FIGS. 5 and 10). As mentioned earlier, transverse barrel latches 29 are included along the outer end edge of sash 44 for selectively locking the movable sash relative to the surrounding window structure.

The first sash 38 has side edges 42 engaged between a first set of track fillers 65 located respectively within the outer tracks of the side channel members 50 at opposed sides of the support frame 30. The sash 38 has first and second parallel end edges 39 and 40 which are perpendicular to the side channel members 50. The first end edge 39 of sash 38 is positioned within the outer track of one of the end channel members 51. It abuts an end track filler 52 fixed within the track (see FIG. 8)

The second sash 44 has side edges 47 engaged between a second set of track fillers 66 located respectively within the inner tracks of the side channel members 50 at opposed sides of the support frame 30. The sash 44 has first and second parallel end edges 45 and 46 which are perpendicular to the side channel members 50. The first end edge 45 of sash 44 is positioned within the inner track of the remaining one of the end channel members 51. It abuts an end track filler 53 (see FIG. 10). The second end edge 46 of sash 44 overlaps the second end edge 40 of sash 38.

Figure 5:
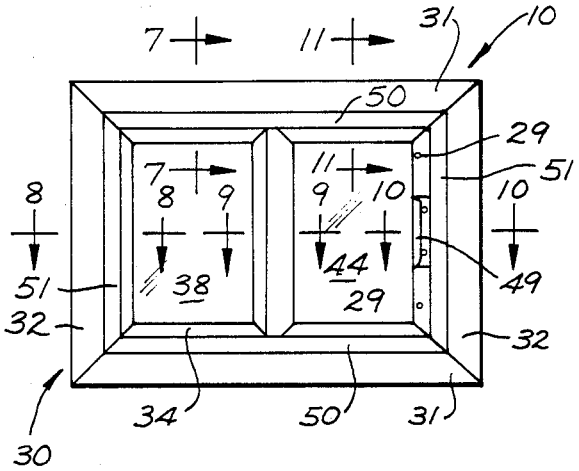
FIG. 5 is an inner elevational view of the window of FIG. 1.
Figure 7:
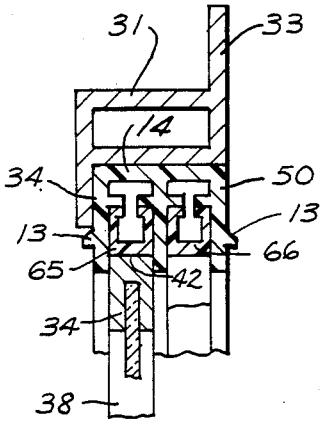
FIG. 7 is a cross-sectional view along line 7—7 in FIG. 5.
Figure 6:
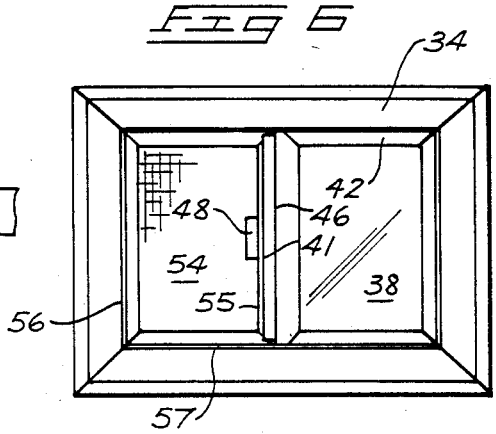
FIG. 6 is an outer elevational view of the window of FIG. 1.
Figure 8:
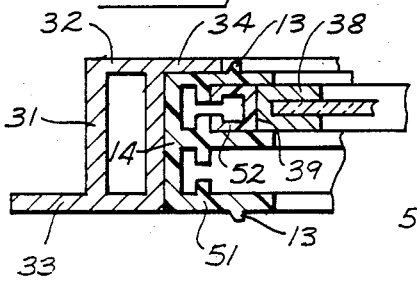
FIG. 8 is a cross-sectional view along line 8—8 in FIG. 5.
Figure 9:
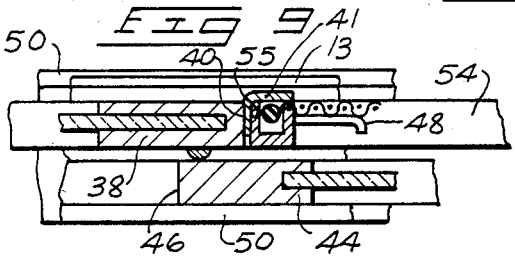
FIG. 9 is a cross-sectional view along line 9—9 in FIG. 5.
Figure 11:
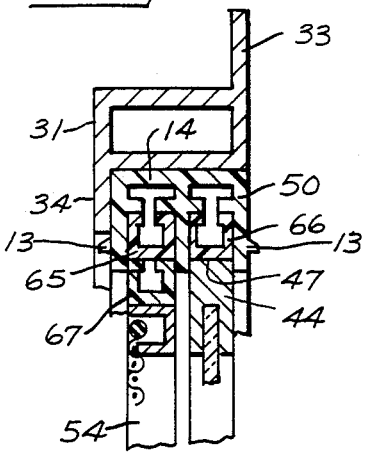
FIG. 11 is a cross-sectional view along line 11—11 in FIG. 5.
Figure 10:
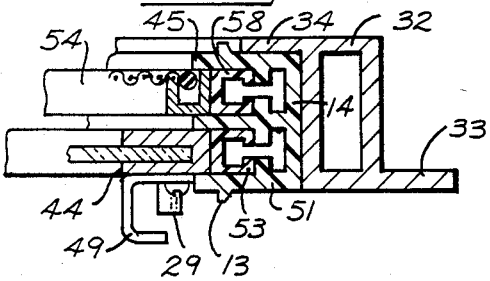
FIG. 10 is a cross-sectional view along line 10—10 in FIG. 5.

A third set of track fillers 67 is located respectively within the outer tracks of the side channel members 50 at opposed sides of the support frame 30 (see FIG. 11). The third set of track fillers 67 overlies a portion of the first set of track fillers 65. They are in engagement with the second end edge 40 of the sash 38 and extend along channel members 50 to abut end fillers 58 in the outer track of the remaining one of said end channel members 51. The track fillers 67 seal sash 54 along its sides and prevent sliding movement of sash 38 relative to support frame 30. Their lengths equal the length of sash 54.

The third sash 54 has side edges 57 engaged respectively between the third set of track fillers 67 at opposed sides of frame 30. Sash 54 has first and second parallel end edges 55 and 56 which are perpendicular to the side channel members 50. The first end edge 55 of sash 54 is engaged with the second end edge 40 of sash 38 (see FIG. 9). The second end edge 56 of sash 54 abuts an end track filler 58 within the outer track of the remaining one of end channel members 51 (see FIG. 10).

With the third set of track fillers 67 installed in side channel members 50, the first sash 38 is held in a fixed position and cannot be moved along channel members 50. This is necessary if the support frame 30 is installed vertically with the first sash 38 normally in an upper raised position.

The first sash 38 has a screen retention lip 41 adjacent its end edge 55. Lip 41 overlaps the first edge 55 of third sash 54 to retain sashes 38 and 54 in alignment. This overlap also prevents removal of the sash 54 from the window exterior.

FIGS. 1 and 5 through 11 show the assembled window components in a normal closed condition. The first and second sashes 38 and 44 (normally containing panes of glass) extend across the window opening and overlap one another at its center. The third sash 54 (normally contains a screen) is located outward from sash 44. It is normally stationary. Sash 54 can be exposed, for ventilation purposes, by sliding sash 44 to the left from its position shown in FIG. 5.

Figure 14:
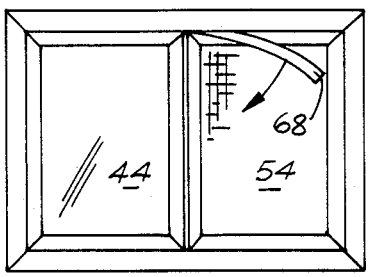
Figure 15:
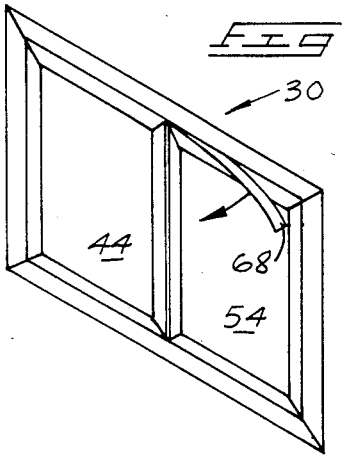

FIGS. 14 through 25 schematically illustrate the removal of sashes from a complete self-storing window 30. In FIGS. 14 and 15, the first sash 38 and second sash 44 are both positioned to the left, with the third sash 54 exposed on the right. One segment 68 of the second set of track fillers 66, having a length slightly greater than the width of second sash 44, is then removed from the inner track of one of the side channel members 50. This provides space within the track to permit sash 44 to be shifted laterally in the window frame after being moved to the right.

Figure 16:
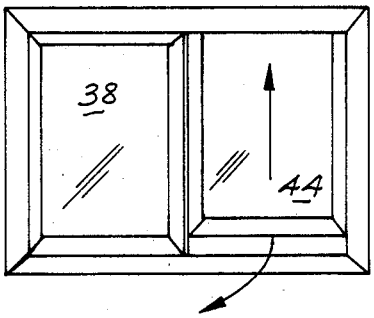
Figure 17:
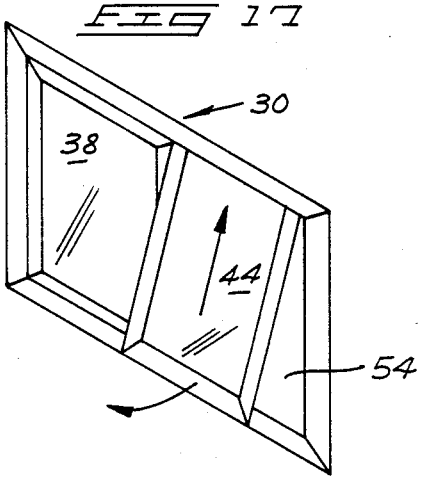

In FIGS. 16 and 17 the sash 44 has been moved to the right along the inner tracks 16 of the two side channel members 50. It has been shifted upwardly into the space created by removal of track filler segment 68. The second sash 44 can now be lifted in an upward direction until its opposite edge clears the inner track of the opposite side channel member 50. The second sash 44 can then be swung inwardly and away from the lower side channel member 50 for removal from the window assembly.

Figure 18:
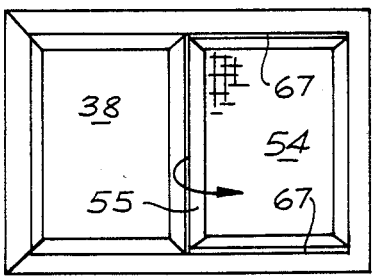
Figure 19:
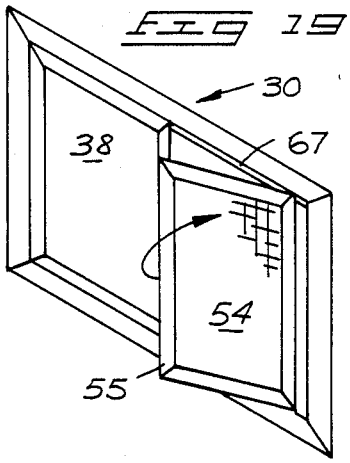

FIGS. 18 and 19 show the window assembly with second sash 44 removed. The first end edge 55 of third sash 54 is no longer overlapped by sash 44 and can be swung in an inward direction as shown. Sash 54 can now be removed from the window assembly.

Figure 20:
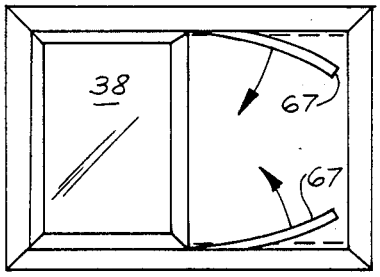
Figure 21:
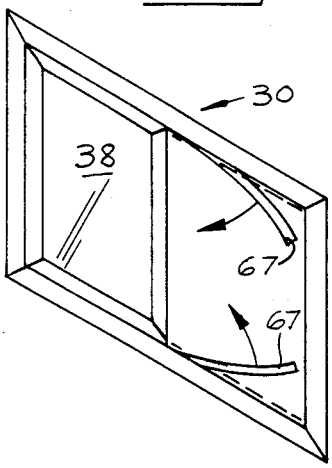
Figure 22:
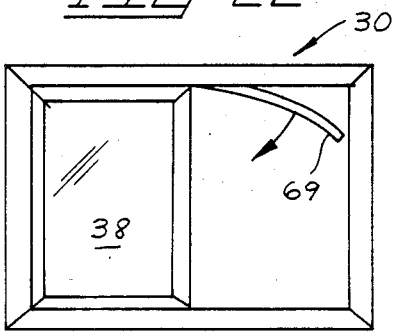
Figure 23:
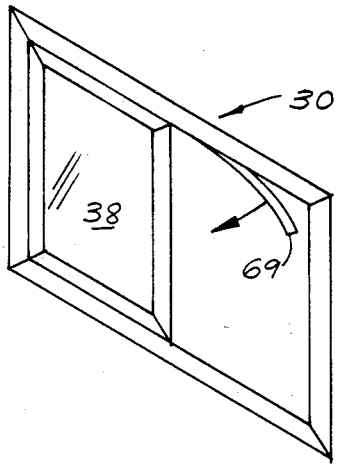

In FIGS. 20 and 21 sash 54 has been removed. This provides access to the third set of track fillers 67. They can now be removed from the outer track of side channel members 50 as shown.

With the third set of track fillers 67 no longer overlying the first set of track fillers 65, one segment 69 of the first set of track fillers 65 can be removed. This segment having a length slightly greater than the width of first sash 38 is removed from the outer track of one of the side channel member 50. This provides space within the track to permit sash 38 to be shifted upwardly after being moved to the right. The removal of this filler segment 69 from the outer tracks is carried out in the manner seen in FIGS. 22 and 23.

Figure 24:
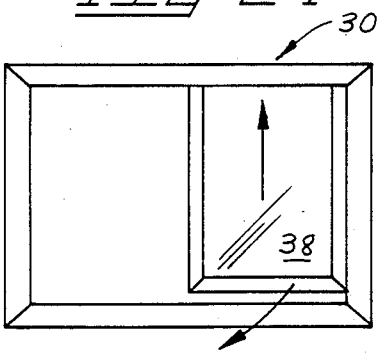
Figure 25:
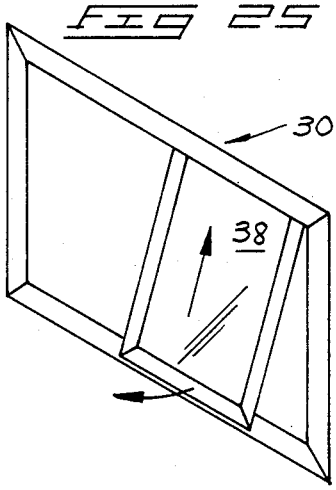

In FIGS. 24 and 25 sash 38 has been moved to the right and shifted upwardly into the space created by removal of segment 69 of the first set of track fillers 65. The first sash 38 can now be lifted in an upward direction until its opposite edge clears the outer track of the opposite side channel member 50. The sash 38 can then be swung inwardly away from the lower side channel member 50 and removed from the window assembly.

With sash 38 removed, disassembly is complete. The steps described above are done in a reverse sequence to re-assemble the window.

The above-described frame system is unique in that it effectively surrounds and seals a self-storing window assembly by use of two extrusions—one for the channel members and one for the track fillers. Most prior designs for such windows required different channel configurations at both sides and at both ends of the window. The use of channel members having an identical cross-sectional shape about the entire frame provides economy in manufacturing costs and a substantial reduction in the inventory needs of a fabricator. Similarly, the track filler profile is extremely versatile, and a common filler extrusion can be used to provide the guiding and interlocking functions described in detail above. Assembly and fabrication of a window is relatively easy, and the resulting window is both functional and visually attractive.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A self-storing window assembly, comprising:

a support frame;

a group of four elongated channel members each having an identical cross-sectional shape and arranged in an enclosed rectangular configuration including two parallel side channel members and two parallel end channel members extending perpendicularly between their respective ends;

each channel member having a base and three substantially parallel walls projecting perpendicularly to one side of the base, the base and walls having inner surfaces forming inner and outer U-shaped open tracks each adapted to receive window sash edges;

a plurality of elongated track fillers having outer surfaces complementary to the open tracks, the track fillers being adapted to be removably positioned within the tracks of a channel member;

a first sash having side edges engaged between a first set of track fillers located respectively within the outer tracks of the side channel members at opposed sides of the frame, said first sash having first and second parallel end edges perpendicular to the side channel members, the first end edge of said first sash being normally positioned within the outer track of one of said end channel members; and a second sash having side edges engaged between a second set of track fillers located respectively within the inner tracks of the side channel members at opposed sides of the frame, said second sash having first and second parallel end edges perpendicular to the side channel members, the first end edge of said second sash being normally positioned within the inner track of the remaining one of said end channel members, and the second end edge of said second sash being overlapped by the second end edge of said first sash.

2. The self-storing window assembly of claim 1 further comprising:

a third set of track fillers located respectively within the outer tracks of the side channel members at opposed sides of the frame, the third set of track fillers overlying said first set of track fillers and being in engagement with the second end edge of said first sash and extending into the outer track of the remaining one of said end channel members to prevent sliding movement of the first sash relative to said frame.

3. The self-storing window assembly of claim 1 further comprising:

a third set of track fillers located respectively within the outer tracks of the side channel members at opposed sides of the frame, the third set of track fillers overlying said first set of track fillers and being in engagement with the second end edge of said first sash and extending into the outer track of the remaining one of said end channel members to prevent sliding movement of the first sash relative to said frame; and a third sash having side edges engaged respectively between the third set of track fillers at opposed sides of the frame, said third sash having first and second parallel end edges perpendicular to the side channel members, the first end edge of said third sash being engaged with the second end edge of said first sash, the second end edge of said third sash extending into the outer track of the remaining one of said end channel members.

4. The self-storing window assembly of claim 3, further comprising:

a lip projecting outwardly along the second end edge of said first sash, said lip overlapping the first end edge of said third sash.

5. The self-storing window assembly of claim 1, wherein the first and second set of track fillers each include corresponding segments having a length slightly greater than the distance between the first and second end edges of said first sash and the first and second edges of said second sash, respectively.

6. The self-storing window assembly of claim 1, further comprising:

a group of four elongated rigid channel retainers arranged in a rectangular configuration including two parallel side channel retainers having two parallel end channel retainers extending perpendicularly between their respective ends;

each elongated rigid channel retainer having a base and two substantially parallel walls projecting perpendicularly to one side of the base, the base and walls having inner surfaces forming a U-shaped configuration complementary to the exterior of said elongated channel members, each channel retainer being adapted to removably support the elongated channel members within the space defined by its base and two walls;

wherein said support frame has two parallel side frame members with an inner surface and two end frame members having an inner surface extending perpendicularly between their respective ends, with said side frame members and end frame members having a flange extending perpendicularly from their inner surfaces;

said support frame being adapted to support said channel retainers parallel to and spaced apart from said flange, forming a U-shaped guideway.

7. The self-storing window assembly of claim 6 further comprising:

elongated grill support members having one opposing end adapted to be positioned in said guideway along one side frame member and the other end adapted to be positioned in the guideway along the other side frame member.

8. The self-storing window assembly of claim 7 further comprising:

a group of four elongated rigid channel retainers arranged in a rectangular configuration including two parallel side channel retainers and two parallel end channel retainers extending perpendicularly between their respective ends;

each elongated rigid channel retainer having a base and two substantially parallel walls projecting perpendicularly to one side of the base, the base and walls having inner surfaces forming a U-shaped configuration complementary to the exterior of said elongated channel members, each channel retainer being adapted to removably support the elongated channel members within the space defined by its base and two walls;

wherein said support frame has two parallel side frame members with an inner surface and two end frame members having an inner surface extending perpendicularly between their respective ends, with said side frame members and end frame members having a flange extending perpendicularly from their inner surfaces;

said support frame being adapted to support said channel retainers parallel to and spaced apart from said flange, forming a U-shaped guideway;

an elongated mounting flange projecting outward from each channel retainer base in a direction opposite to the two channel retainer walls, said mounting flange being located to one side of a center line extending along the base of said channel retainer.

9. The self-storing window assembly of claim 1 further comprising:

a group of four elongated rigid channel retainers arranged in a rectangular configuration including two parallel side channel retainers and two parallel end channel retainers extending perpendicularly between their respective ends;

each elongated rigid channel retainer having a base and two substantially parallel walls projecting perpendicularly to one side of the base, the base and walls having inner surfaces forming a U-shaped configuration complementary to the exterior of said elongated channel members, each channel retainer being adapted to removably support the elongated channel members within the space defined by its base and two walls;

wherein said support frame has two parallel side frame members with an inner surface and two end frame members having an inner surface extending perpendicularly between their respective ends, with said side frame members and end frame members having a flange extending perpendicularly from their inner surfaces;

said support frame being adapted to support said channel retainers parallel to and spaced apart from said flange, forming a U-shaped guideway;

an elongated mounting flange projecting outward from each channel retainer base in a direction opposite to the two channel retainer walls, said mounting flange being located to one side of a center line extending along the base of said channel retainer;

said channel member walls having outer surfaces with elongated shoulders thereon spaced above the channel member base, the inner surfaces of the channel retainer walls having elongated grooves complementary to said shoulders adapted to removably interlock the channel member within the channel retainer.

* * * * *